US009307818B2

(12) United States Patent
Vanderberg

(10) Patent No.: US 9,307,818 B2
(45) **Date of Patent: *Apr. 12, 2016**

(54) BACKPACK COLLAPSIBLE COOLERS

(71) Applicant: M&C Innovations, LLC, Charlotte, NC (US)

(72) Inventor: Matthew Alexander Vanderberg, Charlotte, NC (US)

(73) Assignee: M&C Innovations, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/531,789

(22) Filed: Nov. 3, 2014

(65) Prior Publication Data

US 2015/0108184 A1 Apr. 23, 2015

Related U.S. Application Data

(63) Continuation of application No. 13/526,477, filed on Jun. 18, 2012, now Pat. No. 8,875,964.

(60) Provisional application No. 61/497,943, filed on Jun. 16, 2011.

(51) Int. Cl.

| | |
|---|---|
| ***A45F 3/00*** | (2006.01) |
| ***A45C 11/20*** | (2006.01) |
| ***A45F 3/04*** | (2006.01) |
| ***F25D 3/08*** | (2006.01) |
| ***A45C 7/00*** | (2006.01) |
| ***A45C 5/06*** | (2006.01) |

(52) U.S. Cl.

CPC . *A45C 11/20* (2013.01); *A45C 5/06* (2013.01); *A45C 7/0077* (2013.01); *A45F 3/04* (2013.01); *F25D 3/08* (2013.01); *A45F 2003/001* (2013.01); *A45F 2003/003* (2013.01); *F25D 2331/8011* (2013.01)

(58) Field of Classification Search

CPC ..... F25D 23/06; F25D 23/065; F25D 23/066; F25D 3/08; F25D 2331/8011; A45F 3/04; A45F 3/08; A45F 2003/001; A45F 2003/003; A45F 7/0077; A45C 7/0018; A45C 7/0022; A45C 7/0031; A45C 7/0036; A45C 7/0063; A45C 7/0077; A45C 11/20; A45C 5/06

USPC ..... 222/175; 220/666, 915.1, 915.2; 224/148.7, 627, 637, 645, 649, 605, 224/259, 628, 586, 678, 654, 655, 657; 62/457.1, 457.7

See application file for complete search history.

(56) References Cited

U.S. PATENT DOCUMENTS

| | | | | |
|---|---|---|---|---|
| 6,053,382 | A * | 4/2000 | Wyant | 224/153 |
| 7,165,705 | B2 * | 1/2007 | Haro | 224/629 |

(Continued)

OTHER PUBLICATIONS

"Silicone" Merriam-Webster.com Merriam-Webster, Feb. 20, 2014.*

*Primary Examiner* — J. Casimer Jacyna
*Assistant Examiner* — Benjamin R Shaw
(74) *Attorney, Agent, or Firm* — Tillman Wright, PLLC; Chad D. Tillman; Jeremy C. Doerre

(57) ABSTRACT

A collapsible backpack cooler includes a base, a collapsible portion, a back portion, and one or more straps configured for use by a user in securing the collapsible backpack cooler to their back. The collapsible backpack cooler is configured to allow the collapsible backpack cooler to transition between an expanded configuration, and a collapsed configuration having a reduced volume as compared to the expanded configuration.

11 Claims, 4 Drawing Sheets

(56) References Cited

U.S. PATENT DOCUMENTS

2007/0251874 A1* 11/2007 Stewart ..... 210/232
2008/0099476 A1* 5/2008 Fung ..... 220/6
2008/0149676 A1* 6/2008 Bartel ..... 224/628
2009/0184143 A1* 7/2009 Witt et al. ..... 224/153
2010/0147015 A1* 6/2010 Vanderberg et al. ..... 62/457.7

* cited by examiner

BACKPACK COLLAPSIBLE COOLERS

CROSS-REFERENCE TO RELATED APPLICATION

The present application is a U.S. continuation patent application of, and claims priority under 35 U.S.C. §120 to, U.S. nonprovisional patent application Ser. No. 13/526,477, filed Jun. 18, 2012, which nonprovisional patent application issued as U.S. Pat. No. 8,875,964 on Nov. 4, 2014, which patent application and patent are incorporated herein by reference, and which application is a nonprovisional of, and claims priority under 35 U.S.C. §119(e) to, U.S. provisional patent application Ser. No. 61/497,943, filed Jun. 16, 2011, which is hereby incorporated herein by reference. Additionally, the present application hereby incorporates by reference each of the following U.S. patents and U.S. patent application publications: U.S. Pat. No. 7,677,580; U.S. Pat. No. 7,387,305; U.S. Pat. No. 7,559,559; U.S. Pat. No. 7,543,828; U.S. Pat. No. 7,549,653; U.S. Pat. No. 7,458,589; U.S. Pat. No. 7,458,590; U.S. Pat. No. 7,458,591; U.S. Pat. No. 7,513,510; U.S. Pat. No. 7,677,581; US 2006/0237923 A1; US 2006/0237924 A1; US 2006/0237925 A1; US 2006/0237926 A1; US 2006/0237927 A1; US 2006/0237928 A1; US 2008/0223071 A1; US 2008/0223862 A1; US 2008/0223072 A1; US 2009/0019882 A1; US 2010/0154464 A1; US 2010/0147015; US 2011/0042390 A1; US 2011/0042391 A1; US 2011/0042392 A1; US 2011/0042393 A1; US 2011/0042394 A1; US 2011/0042395 A1; US 2011/0042396 A1; US 2011/0042397 A1; and US 2011/0042398 A1. Each of these patents and application publications is incorporated herein by reference for purposes of disclosing aspects, features, and embodiments that, when combined with one or more aspects or features of the present invention as disclosed below, constitute embodiments of the present invention. Thus the present invention, inter alia, comprises enhancements, improvements, and alterations of the embodiments of the incorporated references.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to portable coolers. Portable coolers are commonly used to transport chilled items, or to keep items chilled at a location. However, portable coolers can be difficult to transport or travel with.

A need exists for improvement in portable coolers. This, and other needs, are addressed by one or more aspects of the present invention.

SUMMARY OF THE INVENTION

The present invention includes many aspects and features. Moreover, while many aspects and features relate to, and are described in one or more certain contexts, the present invention is not limited to use only in such contexts, as will become apparent from the following summaries and detailed descriptions of aspects, features, and one or more embodiments of the present invention.

Accordingly, one aspect of the present invention relates to a collapsible backpack cooler. The collapsible backpack cooler includes a base, a collapsible portion, a back portion, and one or more straps configured for use by a user in securing the collapsible backpack cooler to their back. The collapsible is configured to allow the collapsible backpack cooler to transition between an expanded configuration, and a collapsed configuration having a reduced volume as compared to the expanded configuration.

In a feature of this aspect, the collapsible portion comprises silicon.

In a feature of this aspect, the collapsible backpack cooler further comprises a handle.

In a feature of this aspect, the collapsible backpack cooler further comprises a lid.

In a feature of this aspect, at least one end of one of the one or more straps is configured to be detachable.

In a feature of this aspect, the collapsible backpack cooler further includes a pocket, and wherein the one or more straps are at least partially detachable for storage in the pocket.

In a feature of this aspect, the collapsible backpack cooler further includes a pocket, and wherein the one or more straps are detachable for storage in the pocket.

In a feature of this aspect, the collapsible backpack cooler includes a spigot.

In a feature of this aspect, the collapsible backpack cooler includes a lining. In one or more implementations, the lining is an anti-microbial lining. In one or more implementations, the lining is an anti-bacterial lining.

In a feature of this aspect, the one or more straps comprise shoulder straps.

In a feature of this aspect, the collapsible backpack cooler includes one or more spigots.

Another aspect of the present invention relates to a method of utilizing a collapsible backpack cooler. The method includes removing one or more items from the collapsible backpack cooler; collapsing the collapsible backpack cooler from an expanded configuration to a collapsed configuration by at least partially collapsing one or more collapsible portions of the collapsible backpack cooler; securing the collapsible backpack cooler to the back of a user using one or more straps of the collapsible backpack cooler; traveling, by the user, with the collapsible backpack cooler secured to the user's back; and removing the collapsible backpack cooler from the back of the user.

In a feature of this aspect, the one or more straps of the collapsible backpack cooler comprise two shoulder straps.

In a feature of this aspect, the collapsible backpack cooler includes a spigot.

In a feature of this aspect, the collapsible backpack cooler includes an anti-bacterial lining.

Another aspect of the present invention relates to a method of utilizing a collapsible backpack cooler. The method includes dispensing liquid from the collapsible backpack cooler; collapsing the collapsible backpack cooler from an expanded configuration to a collapsed configuration by at least partially collapsing one or more collapsible portions of the collapsible backpack cooler; securing the collapsible backpack cooler to the back of a user using one or more straps of the collapsible backpack cooler; traveling, by the user, with the collapsible backpack cooler secured to the user's back; and removing the collapsible backpack cooler from the back of the user.

In a feature of this aspect, the collapsible backpack cooler includes an anti-bacterial lining.

Another aspect of the present invention relates to a collapsible backpack cooler. The collapsible backpack cooler includes a cooler body, the cooler body including a collapsible portion; and one or more straps configured for use by a user in securing the collapsible backpack cooler to their back. The collapsible is configured to allow the collapsible backpack cooler to transition between an expanded configuration, and a collapsed configuration having a reduced volume as compared to the expanded configuration.

Another aspect of the present invention relates to a collapsible backpack cooler as disclosed.

Another aspect of the present invention relates to a method of utilizing a collapsible backpack cooler as disclosed.

Another aspect of the present invention relates to a method of traveling with a collapsible backpack cooler.

Another aspect of the present invention relates to a method of utilizing a collapsible backpack cooler.

Another aspect of the present invention relates to a method as disclosed.

Another aspect of the present invention relates to an apparatus as disclosed.

Another aspect of the present invention relates to a system as disclosed.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
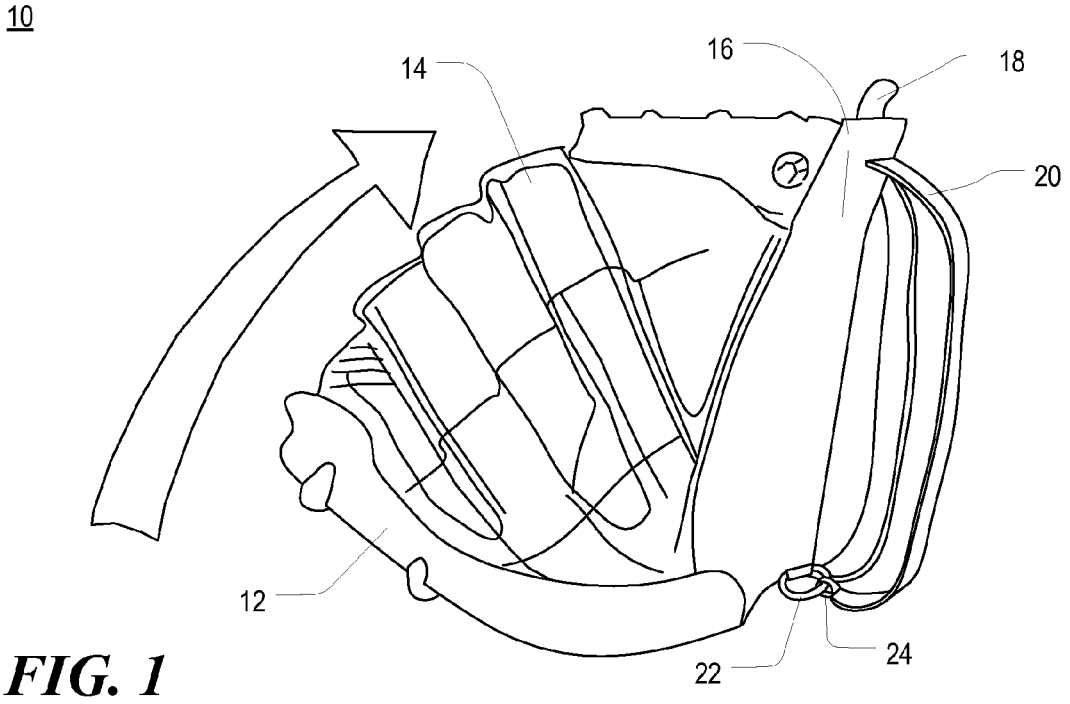
FIG. 1 is a side view of a preferred embodiment of a backpack collapsible cooler in accordance with one or more aspects of the present invention.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 2:
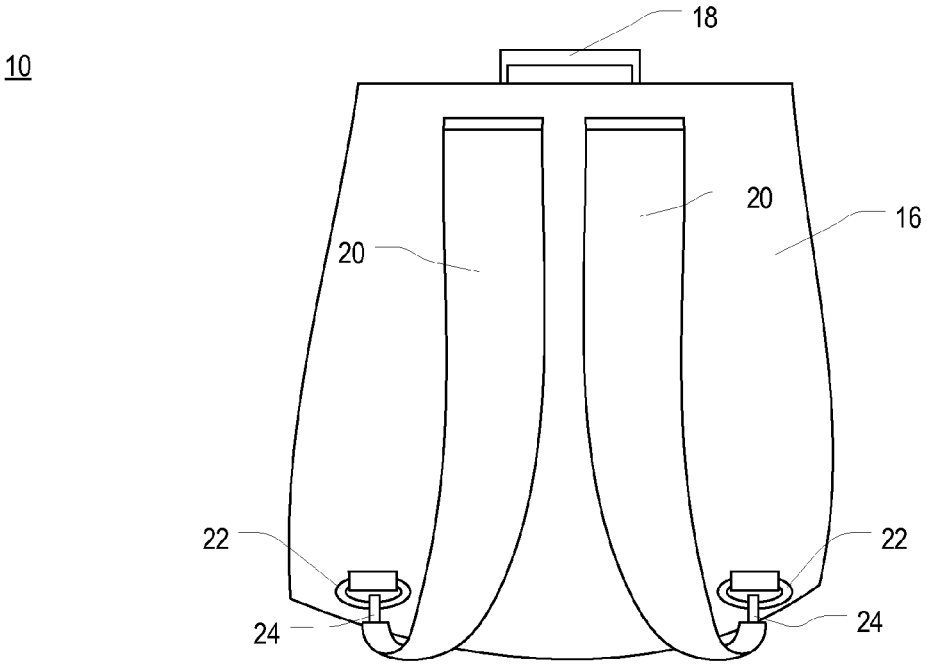
FIG. 2 is a rear view of the backpack collapsible cooler of FIG. 1.

FIG. 1 is a side view of a preferred embodiment of a backpack collapsible cooler 10 in accordance with one or more aspects of the present invention. FIG. 2 is a rear view of the backpack collapsible cooler 10 of FIG. 1. The backpack collapsible cooler 10 comprises a base 12, a collapsible portion 14, a back 16, and a handle 18. The back 16 includes one or more shoulder straps 20 permanently attached proximate the top of the back 16 and one or more rings 22 proximate the bottom of the back 16. Each shoulder strap 20 includes a clip 24 at the bottom thereof adapted to attach to the one or more rings 22. In one or more alternative embodiments, the back does not include one or more rings to which the one or more shoulder straps are removably attachable. Rather, both ends of the one or more shoulder straps are permanently attached to the back.

Figure 3:
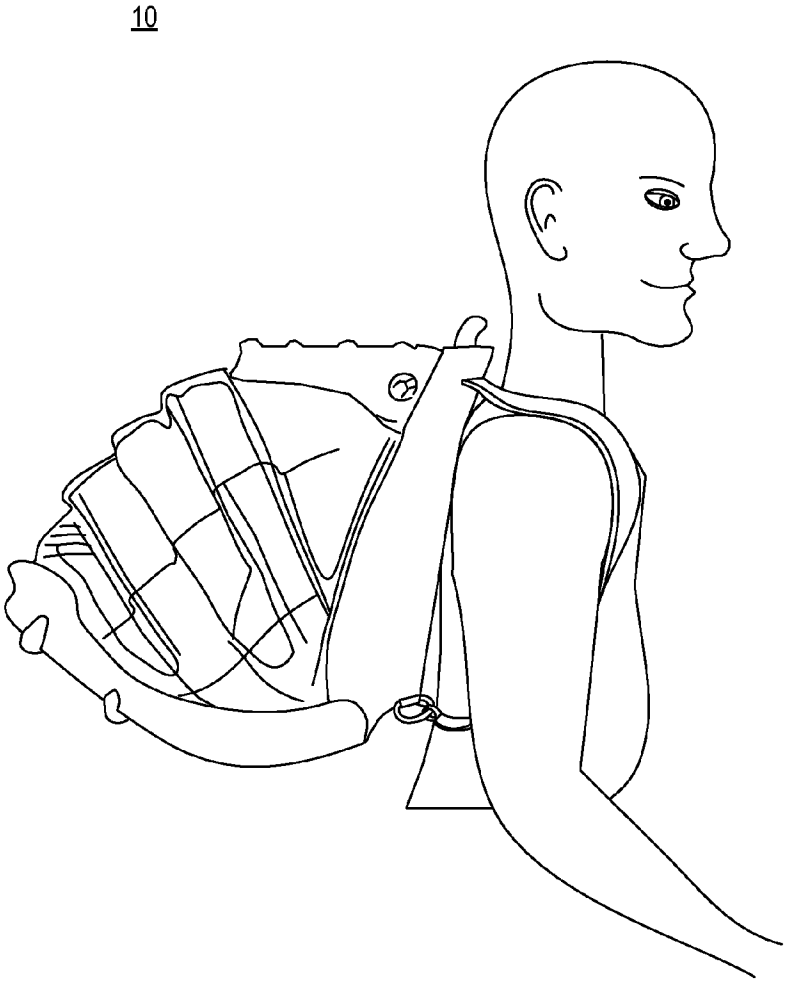
FIG. 3 is a side view of the backpack collapsible cooler of FIG. 1 in use in an expanded configuration.
Figure 4:
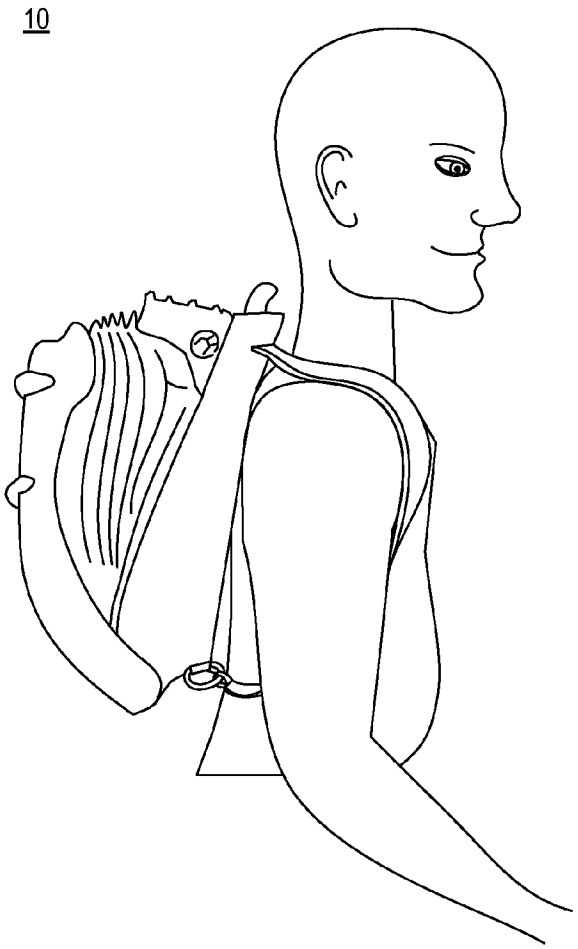
FIG. 4 is a side view of the backpack collapsible cooler of FIG. 1 in use in a collapsed configuration.

FIG. 3 is a side view of the backpack collapsible cooler 10 of FIG. 1 in use in an expanded configuration. FIG. 4 is a side view of the backpack collapsible cooler 10 of FIG. 1 in use in a collapsed configuration. As seen in FIGS. 3 and 4, a user can place his arms through the shoulder straps 20 to transport the cooler on his back.

Figure 5:
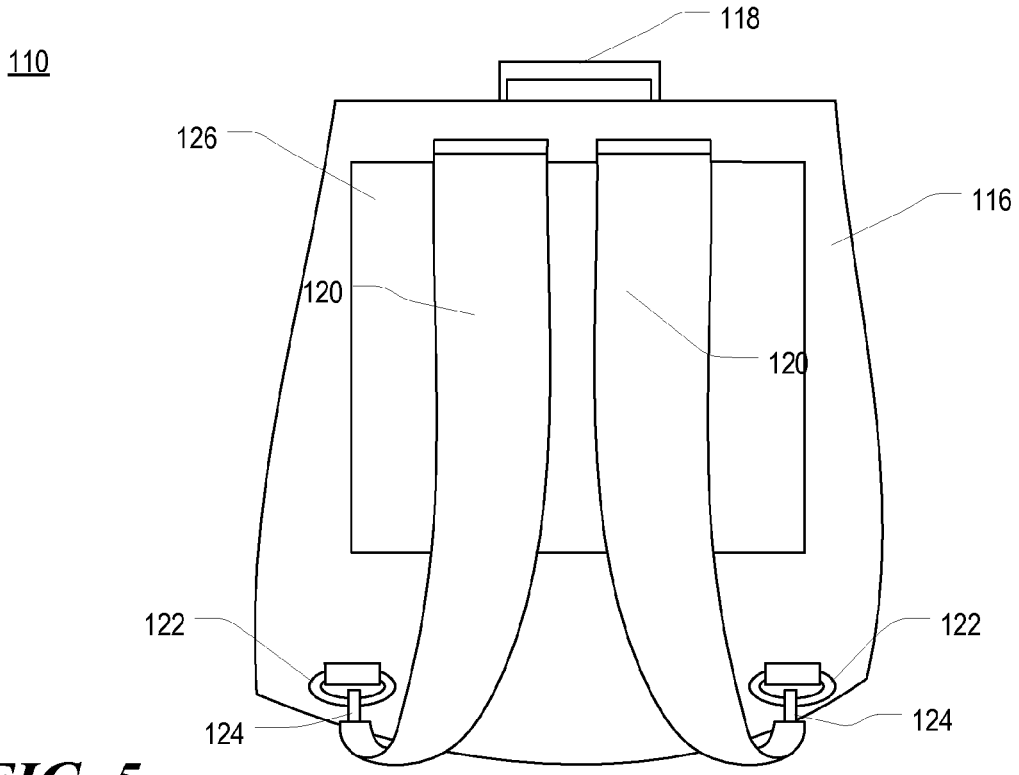
FIGS. 5 and 6 are rear views of a preferred embodiment of a backpack collapsible cooler in accordance with one or more aspects of the present invention.
Figure 6:
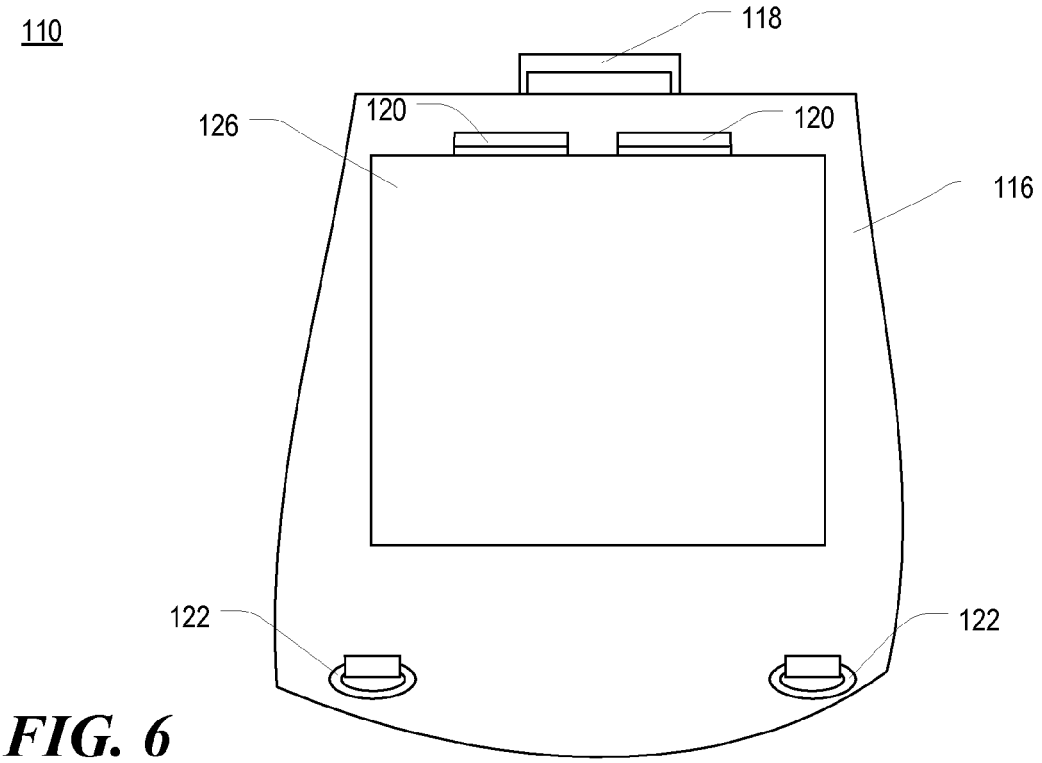

FIGS. 5 and 6 are rear views of a preferred embodiment of a backpack collapsible cooler 110 in accordance with one or more aspects of the present invention. The cooler 110 is generally similar to the cooler 10 described hereinabove with respect to FIGS. 1-4, except with respect to any changes illustrated and those changes now described. In particular, the backpack collapsible cooler 110 includes a pocket 126 on the back 116 for storage of the one or more shoulder straps 120. As most clearly illustrated by FIG. 6, the shoulder straps 120 may be detached from the rings 122 and stored in the pocket 126.

Figure 7:
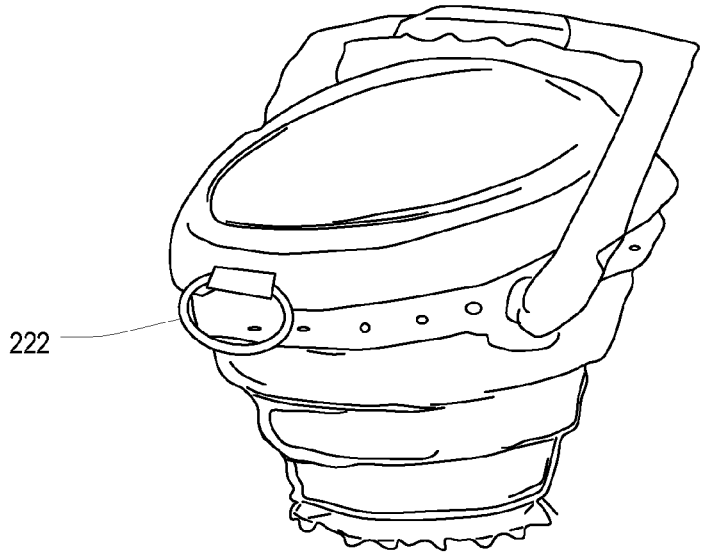
FIG. 7 is a perspective view of a preferred embodiment of a backpack collapsible cooler in an expanded configuration in accordance with one or more aspects of the present invention.
Figure 8:
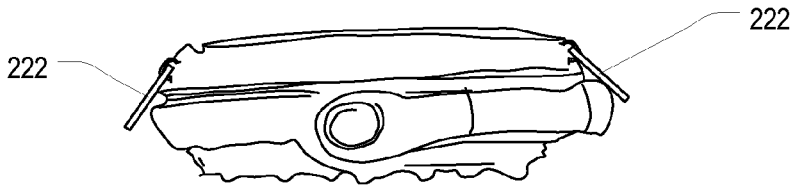
FIG. 8 is a side view of the backpack collapsible cooler of FIG. 7 in a collapsed configuration.
Figure 9:
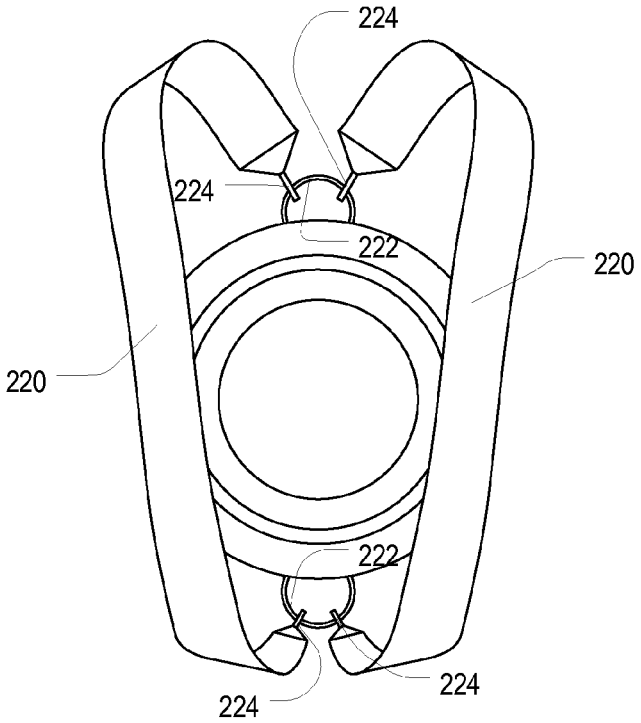
FIG. 9 is a top view of the backpack collapsible cooler of FIG. 7.

FIG. 7 is a perspective view of a preferred embodiment of a backpack collapsible cooler 210 in an expanded configuration in accordance with one or more aspects of the present invention. FIG. 8 is a side view of the backpack collapsible cooler 210 of FIG. 7 in a collapsed configuration. FIG. 9 is a top view of the backpack collapsible cooler 210 of FIG. 7. As shown in FIGS. 7-9, the backpack collapsible cooler 210 includes two rings 222 attached thereto. In at least one preferred embodiment, the rings 222 are proximate a top portion of the cooler 210 and diametrically opposed to one another. As seen in FIG. 9, the cooler 210 includes one or more straps 220 having clips 224 at the ends thereof adapted to attach to the rings 222. When attached to the rings 222, a user may place his or her arms through the straps 220 to carry the cooler 210 on his or her back.

In at least some preferred implementations, a backpack collapsible cooler includes a lining. Preferably, such lining comprises an anti-microbial and/or anti-bacterial lining.

In one or more preferred implementations, a backpack collapsible cooler includes one or more spigots. In one or more preferred implementations, a backpack collapsible cooler functions as a backpack collapsible water cooler.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A collapsible backpack cooler comprising:

(a) a back member for abutment with a wearer's back;

(b) a base extending from a bottom portion of the back member;

(c) one or more collapsible sidewalls secured to the back member and the base, an outer surface of one or more of the one or more collapsible sidewalls tapering downward as it approaches the base;

(d) one or more straps secured to the back member, the one or more straps being configured to allow a wearer to secure the collapsible backpack cooler to his or her back;

(e) a lid configured to provide access to an enclosed interior storage space collectively defined by the lid, the back member, the base, and an inner surface of one or more of the one or more collapsible sidewalls;

(f) wherein the base is secured to the back member in a manner which allows rotative movement of the base generally upwards about a pivot axis at a bottom portion of the back member;

(g) wherein the collapsible backpack cooler is transitionable, via rotation of the base relative to the back member, between (i) an expanded configuration, in which the base extends generally horizontally out from the back member and the interior storage space has a first volume, and (ii) a collapsed configuration, in which the base extends generally vertically upwards and the interior storage space has a second volume less than the first volume;

(iii) wherein the interior storage space is fully enclosed in both the expanded configuration and the collapsed configuration when the lid is closed.

2. The collapsible backpack cooler of claim 1, wherein the collapsible portion comprises silicon.

3. The collapsible backpack cooler of claim 1, wherein the collapsible backpack cooler further comprises a handle.

4. The collapsible backpack cooler of claim 1, wherein the one or more straps are detachable.

5. The collapsible backpack cooler of claim 1, wherein the collapsible backpack cooler further includes a pocket, and wherein the one or more straps are at least partially detachable for storage in the pocket.

6. The collapsible backpack cooler of claim 1, wherein the collapsible backpack cooler further includes a pocket, and wherein the one or more straps are detachable for storage in the pocket.

7. The collapsible backpack cooler of claim 1, wherein the one or more straps are permanently attached to the back member.

8. The collapsible backpack cooler of claim 1, wherein the one or more straps are attached to one or more rings secured to the back member.

9. A collapsible backpack cooler comprising:

(a) a back member shaped and dimensioned for abutment with a wearer's back;

(b) a base extending from a bottom portion of the back member;

(c) one or more collapsible sidewalls secured to the back member and the base, an outer surface of one or more of the one or more collapsible sidewalls incrementally tapering downward in discrete jumps as it approaches the base;

(d) one or more straps secured to the back member, the one or more straps being configured to allow a wearer to secure the collapsible backpack cooler to his or her back;

(e) a lid configured to provide access to an interior storage space collectively defined by the lid, the back member, the base, and an inner surface of one or more of the one or more collapsible sidewalls;

(f) wherein the base is secured to the back member in a manner which allows rotative movement of the base generally upwards about a pivot axis at a bottom portion of the back member;

(g) wherein the collapsible backpack cooler is transitionable, via rotation of the base relative to the back member, between (i) an expanded configuration, in which the base extends generally horizontally out from the back member and the interior storage space has a first volume, and (ii) a collapsed configuration, in which the base extends generally vertically upwards and the interior storage space has a second volume less than the first volume;

(iii) wherein the interior storage space is fully enclosed in both the expanded configuration and the collapsed configuration when the lid is closed.

10. The collapsible backpack cooler of claim 9, wherein the collapsible portion comprises silicon.

11. The collapsible backpack cooler of claim 9, wherein the collapsible backpack cooler further comprises a handle.

* * * * *